US005915824A

United States Patent [19]

Straat

[11] Patent Number: 5,915,824

[45] Date of Patent: Jun. 29, 1999

[54] DETACHABLE LIGHT FIXTURE FOR SHELVING

[76] Inventor: Patricia Ann Straat, 830 Windy Knoll, Sykesville, Md. 21784

[21] Appl. No.: 08/808,399

[22] Filed: Feb. 28, 1997

[51] Int. Cl.[6] ..... F21V 33/00

[52] U.S. Cl. ..... 362/133; 362/127; 312/223.5

[58] Field of Search ..... 362/125, 127, 362/132, 133, 285, 432; 312/223.5

[56] References Cited

U.S. PATENT DOCUMENTS

| | | | |
|---|---|---|---|
| 2,157,264 | 5/1939 | Kirby, Jr. | 362/133 |
| 2,749,430 | 6/1956 | Cohn | 362/432 |
| 4,689,726 | 8/1987 | Kretzschmar | 362/127 |
| 5,034,861 | 7/1991 | Sklenak et al. | 362/133 |

*Primary Examiner*—Laura Tso
*Attorney, Agent, or Firm*—Robert T. Braun

[57] ABSTRACT

The present invention relates to a quickly releasable removably engaged light source for use with a display shelf. A shortened display shelf having a top and bottom, a front and a back edge is mounted to a wall such as the back edge of the display shelf has an air-gap between it and the surface to which it is mounted. A removable light support member is releasably engaged with the back edge of the shelf. On the back of the light support member, there is a light attached thereon. The distance between the back of the removable light support and the surface to which the shelf is mounted is such that an air-gap is created between them so that the quickly releasable support member and attached light can be removed from the shelf without the light on the back of the removable light support member hitting the surface. The present invention can also be used in display units wherein a shortened shelf is held within the display unit and a air-gap is created between the back edge of the shortened shelf held within the display unit and the back wall of the display unit. The air-gap is sized such that when the quickly releasable light support member is engaged with the back edge of the shortened shelf, there is sufficient room between the back of the releasable light support member and the rear wall of the display unit so that the light attached to the back of the releasable light support member can be easily removed from the display unit without hitting the rear wall of the display unit.

19 Claims, 5 Drawing Sheets

DETACHABLE LIGHT FIXTURE FOR SHELVING

BACKGROUND OF THE INVENTION

1. Field of the Invention

This invention relates in general to light fixtures, and in particular, to light fixtures associated with shelving. More specifically, but without restriction to the particular embodiments hereinafter described in accordance with the best mode of practice, this invention relates to a quick-release light fixture that casts multi-directional light from behind an opaque shelf.

2. Discussion of the Related Art

In the modern world, humankind has increasingly populated its environment. As the population has grown, the space for each individual has decreased. As each individual's office and home space has become smaller, so has the furniture that is used in those spaces. One particular kind of furnishing which has decreased in size includes display shelves, book shelves, and china cabinets. In the past, book shelves and china cabinets were very large pieces of furniture that were not illuminated by light. As work space, office space, and home living space had a higher premium placed thereon, these china cabinets have become small and more decorative in nature. As they became more decorative in nature, the china cabinets, display shelves, entertainment centers, bookshelves, and other display units began to include lighting so that people could better see the things displayed on the shelves. In particular, china cabinets and display shelves are lit so that people may easily view the china, knick-knacks, and books thereon. Additionally, lights and lighting in display units, china cabinets, display shelves, and the like are used to create atmosphere.

In the past, there have been many ways of putting lighting on shelves. One of the ways was merely to place a lamp on the shelf. This had the disadvantages of being easily knocked off the shelf and of taking a large amount of shelf space. As time went on, lights were developed that were fastened fixedly to the shelves of the display units, china cabinets, entertainment centers, and display shelves. The light in prior display units, china cabinets, entertainment centers, and display shelves was usually uni-directional. Some shelving in some prior display units have light which is bi-directional. This bi-directional lighting was accomplished primarily through the use of transparent surfaces such as glass.

The prior methods of shelf lighting have the disadvantage that light bulbs were exceedingly hard to change as the lights were fixed to the shelf or display unit. Usually the user would have to empty out all the books, knick-knacks, or china being displayed to ensure that he would not knock over and damage them while changing the lightbulb. A further limitation in prior display units includes problems in illuminating opaque shelves. The lighting of opaque shelving was typically uni-directional. Even in units that had bi-directional lighting through transparent surfaces, a way to easily change light bulbs has not previously hereto been provided. In addition to the above limitations, prior illuminated display units had unattractive electric power cords that were frequently in view of the user. Thus, prior to this invention, there has not been disclosed any convenient way to provide bi-directional lighting with light bulbs being easily changed for opaque shelving while hiding from view unattractive electric power cords.

OBJECTS AND SUMMARY OF THE INVENTION

It is, therefore, an object of the present invention to improve illuminated shelves.

Another object of this invention is to enable a user to easily change a light bulb attached to a shelf of display unit.

It is a further object of the present invention to provide a shelving unit with a light source which is easily removable for changing the light.

Another object of this invention is to provide a removable light source which will provide bi-directional light for shelves fastened to walls or display units.

It is the further object of the present invention to provide a readily detachable light source that also prevents items from falling off the shelf.

Still another object of the present invention is to provide a removable bi-directional light source wherein the electric cord is hidden from a viewer.

It is yet a further object of the present invention to provide a removable bi-directional light source wherein the light is amplified by a reflective bracket.

An additional object of the present invention is to provide a removable light source by means of an air gap between a wall and the removable light source holder attached to the shelving.

Yet a further object of the present invention is to provide a removable light source wherein the light source is held to a removable member engaged with the shelving unit by an easily attached J-shaped bracket.

These and other objects are attained in accordance with the present invention wherein there is provided an illuminated display shelf for mounting to a support surface which includes at least one shelf having a top and a bottom surface and a front and a back edge, at least one support member for attaching the shelf to the support surface, a removable light support member releasably engaged with the back edge of the shelf, the light support member being spaced away from the surface to provide an air-gap therebetween, and a light attached to the light support member. According to one aspect of this invention, the removable light support member is releasably engaged with the back edge by hook and loop fastener material or alternatively, the removable light support member has a front face containing a groove for snugly engaging the back edge of the shelf.

The illuminated display shelf according to the present invention may further include a light holding bracket for mounting the light, the light holding bracket being secured to the removable light support member. In conjunction with this aspect of the present invention, the light holding bracket is secured to the removable light support member by at least one strap. The at least one strap may be loosened to allow precise positioning of the light holding bracket along a longitudinal center line of the removable light support member. The shelf in this embodiment of the invention may be fixed to the support surface or alternatively removable from the support surface.

According to another aspect of this invention, the light holding bracket has a long side having an inner and outer surface and a short side having an inside and outside surface, the outer surface having an insulation attached thereon to reduce heat transfer from the light to the light support member. In this embodiment, the inside surface may have insulation affixed thereon and may preferably include reflective material placed on the inside surface. The light holding bracket may be made of a non-conductive material, or a reflective material, or a reflective non-conductive material.

According to another embodiment of the present invention, there is provided a display unit including a frame having a back and a supporting sides, at least one shelf having a front and a back edge, the back edge of the shelf being spaced away from the back to provide a gap therebetween, a removable light support member releasably engaged with the back edge of the shelf, the removable light support member being releasable from the shelf through the gap, and a light attached to the light support member.

In accordance with one aspect of this embodiment of the present invention, a light holding bracket for mounting the light is provided. The light holding bracket is secured to the removable light support member, and may be secured to the removable light support member by at least one strap. This at least one strap may be preferably loosened to allow precise positioning of the light holding bracket along a longitudinal center line of the removable light support member.

According to another aspect of this embodiment of the present invention, the light support member may include a longitudinal bore for containing an electric supply cord extending from the light, the longitudinal bore thereby hiding the electric supply cord from view. The removable light support member may be releasably engaged with the back edge by hook and loop fastener material or alternatively the removable light support member may have a front face containing a groove for snugly engaging the back edge of the shelf wherein the removable light support member is releasably engaged with the back edge by a dadoed groove running the length of the removable light support member.

In accordance with yet another aspect of this embodiment of the present invention the light holding bracket preferably has a long side having an inner and outer surface, and a short side having an inside and outside surface, the outer surface having an insulation attached thereon to reduce heat transfer from the light to the light support member. The inside surface may also have insulation affixed thereon, and the insulation on the inside surface may preferably have a reflective material affixed thereon. The light holding bracket according to this aspect of the present embodiment may be made of a non-conductive material, or a reflective material, or alternatively a reflective non-conductive material.

According to still another aspect of this invention, there is provided a method for illuminating a display shelf which includes the steps of providing at least one shelf having a top and a bottom surface and a front and a back edge, attaching the shelf to a support surface by at least one support member, engaging a removable light support member with the back edge of the shelf so that the light support member is quickly releasable from the back edge, the light support member being spaced away from the surface to provide an air-gap therebetween, and positioning a light on the light support member so that when the light support member is engaged with the back edge of the shelf, light is directed into the air-gap and above and below the shelf.

BRIEF DESCRIPTION OF THE DRAWING

Further objects of the present invention together with additional features contributing thereto and advantages accruing therefrom will be apparent from the following description of the preferred embodiments of the invention which is shown in the accompanying drawing, wherein.

DETAILED DESCRIPTION OF A PREFERRED EMBODIMENT

Figure 1:
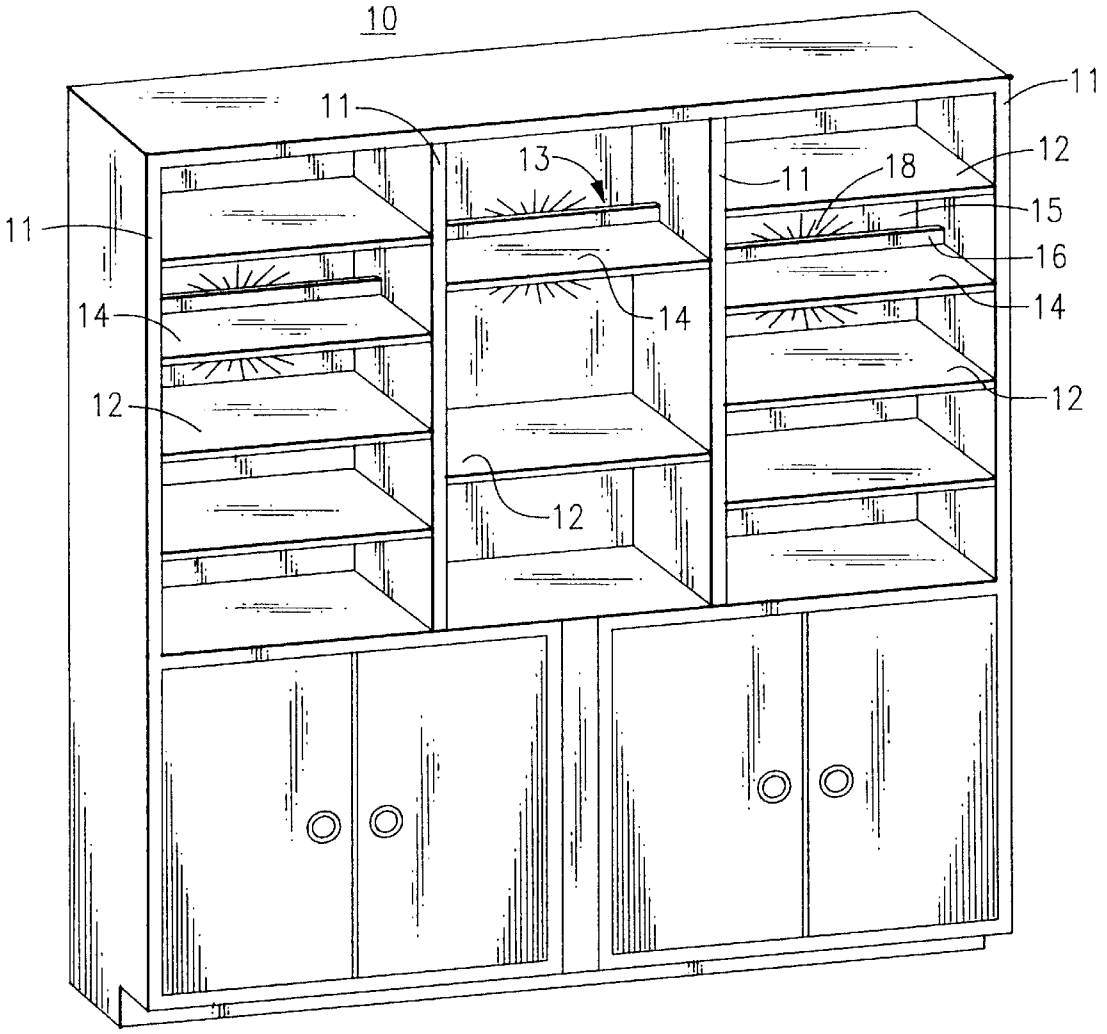
FIG. 1 is a perspective view of a shelving unit incorporating the various aspects of the present invention.

Referring now to FIG. 1, there is shown a shelving unit 10 in accordance with the present invention. The shelving unit 10 contains several shelves 12 and three shortened shelves 14. The shortened shelf 14 has an air-gap 13 between its back edge 22, FIG. 2, and a rear wall 15 of the shelving unit 10. On the back edge 22 of the shortened shelf 14 there is a light support member 16 for holding a light 18, FIG. 6. The light 18 provides bi-directional 19 light to the shortened shelf 14, the air-gap 13 and the normal shelf 12 above and below the shortened shelf 14.

Figure 2:
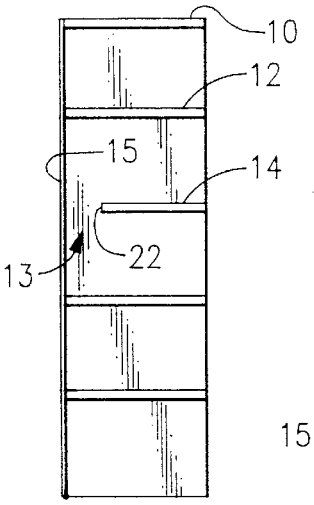
FIG. 2 is a side elevation of the upper portion of the shelving unit having a shelf according to the teachings of the present invention.

Turning now to FIG. 2, there is shown an upper portion of the shelving unit 10 including several shelves 12 and the shortened shelf 14. The shelves 12 shown in comparison with the shortened shelf 14 having the air-gap 13 between the back edge 22 of the shortened shelf 14 and the rear wall 15. The air-gap 13 is an important aspect of this invention because air-gap 13 allows the light support member 16, FIGS. 1, 3, 4A and 4B, to be easily disengaged for a change of the light 18, FIGS. 4B and 6. Further, the air-gap 13 allows the light 18 to provide bi-directional light 19 above and below the shortened shelf 14.

Figure 3:
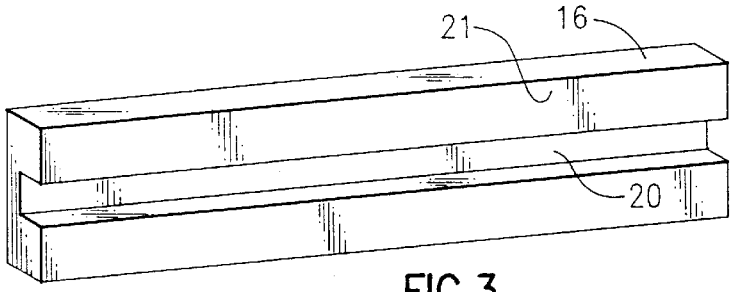
FIG. 3 is perspective view of a light support member in accordance with the present invention.

Turning now to FIG. 3, there is shown the light support member 16. The light support member 16 has a groove 20 running the length of a front face 21, so that the light support member 16 can be snugly engaged with the back edge 22, FIG. 2 and 4A, of shortened shelf 14.

Figure 4A:
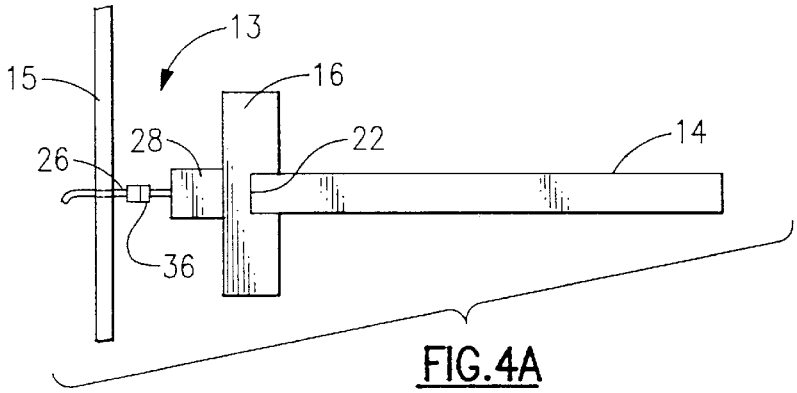
FIG. 4A is a side view of a shelf showing the light support member of FIG. 3 in conjunction therewith.
Figure 4B:
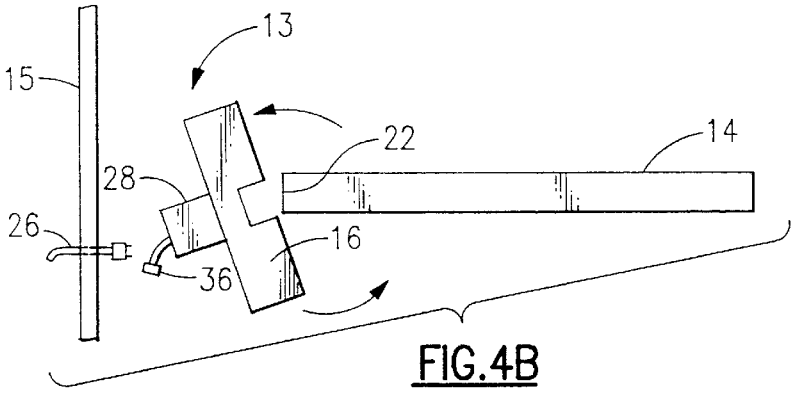
FIG. 4B is a view similar to 4A showing removal of the light support member.

FIG. 4A shows the shortened shelf 14 and the light support member 16 with the air-gap 13 between the shortened shelf 14 and the rear wall 15. The light support member 16 is provided with a light holding bracket 28 containing the light 18, FIG. 6, which is provided with electrical power by an electric cord 26 having an electric coupling 36. It can be seen that the light support member 16 is engaged with the back edge 22 of the shortened shelf 14. The fit between the light support member 16 and the back edge 22 of the shortened shelf 14 is preferably such that there is enough clearance to remove the light support member 16, but not enough slippage that the light support 16 could fall off easily. In one preferred embodiment, the air-gap 13 is dimensioned such that accidental rotation of the light support member 16 will cause the light support member 16 to tip against the rear wall 15, thereby preventing the light support member 16 from dropping through the air-gap 13. In addition, in another preferred embodiment, FIG. 1, the tolerance between the length of the light support member 16 and sides 11 is such that the light support member 16 is supported by adjacent sides 11 when accidentally disengaged from the back edge 22 of the shortened shelf 14. The appropriate clearance between the groove 20 and the shortened shelf 14 provides a snug fit between the light support member 16 and the shortened shelf 14 so that they may be easily disassembled from each other by unplugging the electric coupling 36 and disengaging the light support member 16 from the back edge 22 of the shortened shelf 14 as shown in FIG. 4B. The snug fit thus plays a role in protecting items displayed beneath the shortened shelf 14. In the preferred embodiment, the light support member 16 is a piece wood having a dadoed groove 20 in the front face 21 that snugly fits with the back edge 22 of the shortened shelf 14. It should be appreciated with reference to FIGS. 4A, 4B, and 4H that a hook and loop fastener 23 like (VELCRO™) could be placed in the groove 20 and on the back edge 22 of shortened shelf 14. This has the additional benefit that the groove 20 does not have to be as precisely manufactured as it would if there were no hook and loop fastener in the groove 20 and 30 on the back edge 22 of the shortened shelf 14. Lastly, it can be seen that the light support member 16 when engaged with the back edge 22 of the shortened shelf 14 has the added benefit of preventing objects displayed on the shortened shelf 14 from falling off the shortened shelf 14 into the air-gap 13 between the back of the light support member 16 and real wall 15.

FIG. 4B shows the shortened shelf 14 with the light support member 16 in the air-gap 13 between the back edge 22 of shortened shelf 14 and the rear wall 15. FIG. 4B further shows that the electric cord 26 is readily unplugged at the electric coupling 36 to remove the light support member 16 from the back edge 22 of the short shelf 14. It can be seen that the light support member 16 has been disengaged from the back edge 22 of the shortened shelf 14. The light support member 16 can easily be disengaged into the air-gap 13 by the user wishing to change the light 18, thereby allowing easy change of the light 18.

Figure 4C:
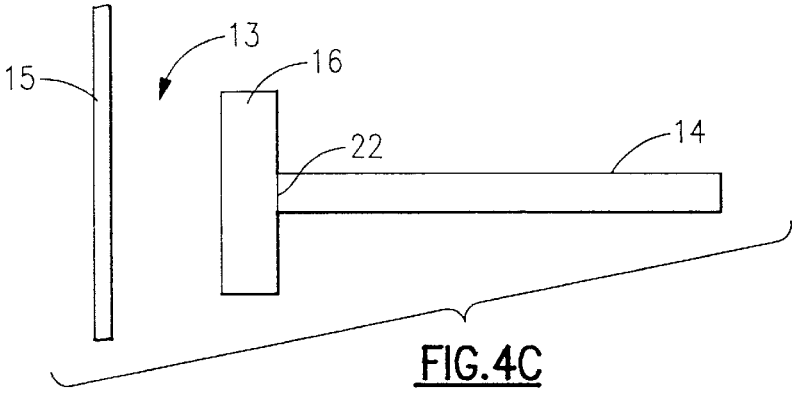
FIG. 4C is a side view of an alternative embodiment of a shelf and alternative support member according to the present invention.
Figure 4D:
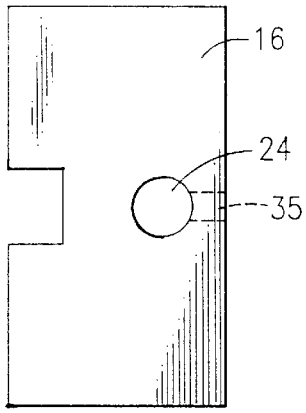
FIG. 4D is a side view of the light support member showing the hideaway tunnel for hiding an electric cord according to the present invention.
Figure 4G:
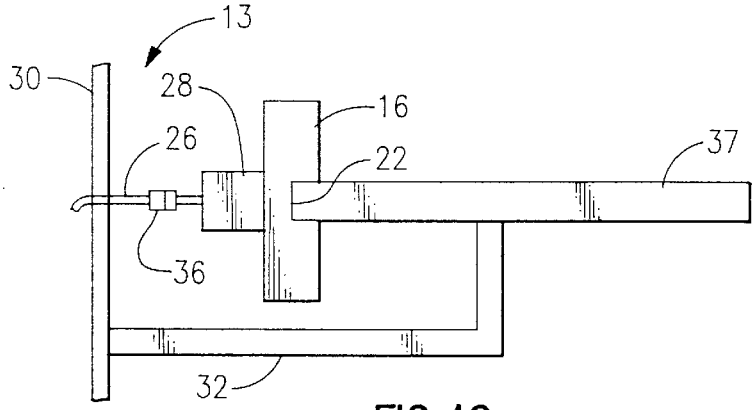
FIG. 4G shows an alternative embodiment for supporting a display shelf according to the present invention.
Figure 4E:
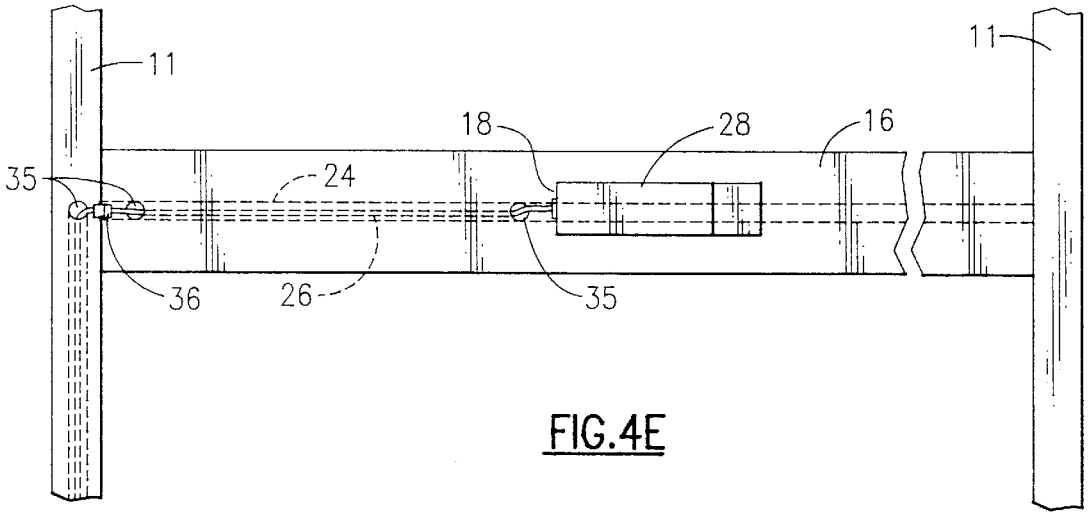
FIG. 4E is a rear elevation of a shelving unit showing the light bracket and cord assembly in accordance with the present invention.
Figure 4F:
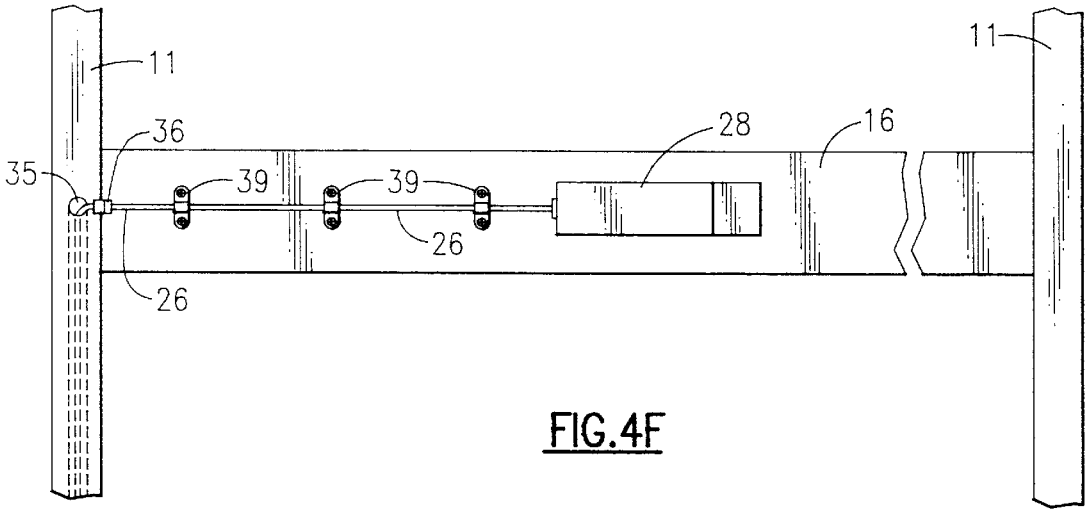
FIG. 4F is a view similar to FIG. 4E showing an alternative embodiment for connecting the electric cord to the light.
Figure 4H:
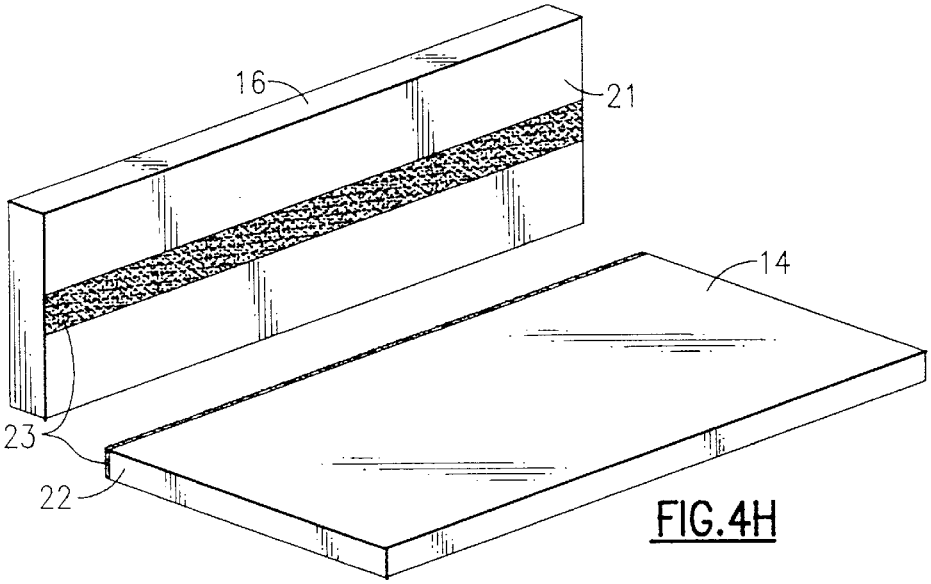
FIG. 4H is a perspective view of the shelf and light support member including a hook and loop fastener connection in accordance with one embodiment of the present inventon.

Referring now to FIGS. 4C and 4H, an alternative embodiment of the shortened shelf 14 and the light support member 16 is shown. It can be seen that having a hook and loop fastener 23 on the back edge 22 of the shortened shelf 14 and a hook and loop fastener 23 in the middle of the front face 21 of the light support member 16 eliminates the need for the groove 20, thereby removing a manufacturing step.

Now turning to FIGS. 4D and 4E, there is shown the light support member 16 having a tunnel 24 which is a blind bore that extends a predetermined length along the light support member 16 terminating in exit openings 35 for carrying the electric cord 26 to the light 18 for supplying power and hiding the electric cord 26 within the tunnel 24. The tunnel 24 is formed by drilling the bore into one end of the light support member 16 down its length to a predetermined depth. Each exit opening 35 in the light support member 16 is formed by drilling a perpendicular hole through the back of the light support member 16 into the exit tunnel 24. The tunnel 24 is preferably formed along the longitudinal center line of light support member 16. The tunnel 24 has the additional benefit of hiding the electric cord 26 from view. As shown in FIG. 4E, the shortened shelf 14 with the light support member 16 is supported between the two sides 11 of the shelving unit 10. The tunnel 24 in the light support member 16 contains the electric cord 26 which is attached through the exit opening 35 to the light 18 at one end, and attached to the electric coupling 36 through the exit opening 35 at the other end and continues through another exit opening 35 in the side 11 of the shelving unit 10 as shown in FIG. 4E. The electric coupling 36 is located near the side 11 so that the light support member 16 can be easily disengaged from the back edge 22 of the shortened shelf 14 by unplugging the electric coupling 36.

FIG. 4F shows an alternative embodiment for connecting the electric cord 26 to the light through the exit opening 35 in the side 11. The electric cord 26 extends through the exit opening 35 in the side 11 and is coupled to the electric coupling 36 near the side 11 as shown. The electric cord 26 continues from the electric coupling 36 through several eye hooks 39 to the light 18 contained within the bracket 28. This embodiment has the advantage that the tunnel 24 does not have to be blind bored into the light support member 16 and eliminates the need for the two exit openings 35 in the light support member 16. It should be appreciated that the hook 39 does not have to be an eye hook. It could alternatively be a J-hook or any other suitable means capable of supporting the electrical cord 26.

FIG. 4G shows an alternative embodiment which includes a display shelf 37 having the back edge 22. The display shelf 37 is mounted to a surface 30 such as a wall. The display shelf 37 is mounted to the surface 30 by a mounting bracket 32. It can be seen that the back edge 22 of the display shelf 37 is engaged with the light support member 16 which in turn has the light 18 mounted thereon. The light 18 is supplied power through the electric cord 26 which extends substantially perpendicularly from surface 30 directly behind the bracket 28 and the light support member 16 thereby hiding the electric cord 26 from view. The length of the light support member 16 can be modified to be shorter or longer than the length of the display shelf 37 so that the light support member 16 engages only a portion of the back edge 22 or all of the back edge 22, respectively, of the display shelf 37. Modifying the length of the light support member 16 so that it is shorter than the display shelf 37, would allow the light support member 16 or multiple light support members 16 to be easily removable from the back edge 22 of display shelf 37 between two mounting brackets 32. It should be further appreciated viewing FIG. 4E that the electric cord 26 is hidden from the view of anyone looking at the display shelf 37 by being positioned directly behind light support member 16. The electric cord 26 further contains the electric coupling 36 which is separable so that the light support member 16 may be disengaged from the back edge 22 of the display shelf 37 for easy change of the light 18. Additionally, it should be appreciated from the present disclosure that the electric cord 26 could be fixedly attached to the light 18 by providing a longer length electric cord 26 within surface 30 such that the electric cord 26 would pull out of surface 30 when light support member 16 was disengaged from the back edge 22 of the display shelf 37 for changing the light 18. Further, the electric cord 26 could be retracted back into the surface 30 or pushed back into the surface 30 when the light support member 16 was re-engaged with the back edge 22 of the display shelf 37 after the light 18 was changed. The retractable feature of the electric cord 26 may be implemented by use of a recoiling mechanism mounted behind surface 30 or within shelving unit 10. These modifications to the electric cord 26 may be applied to the embodiment shown in FIGS. 1–4F.

Figure 5:
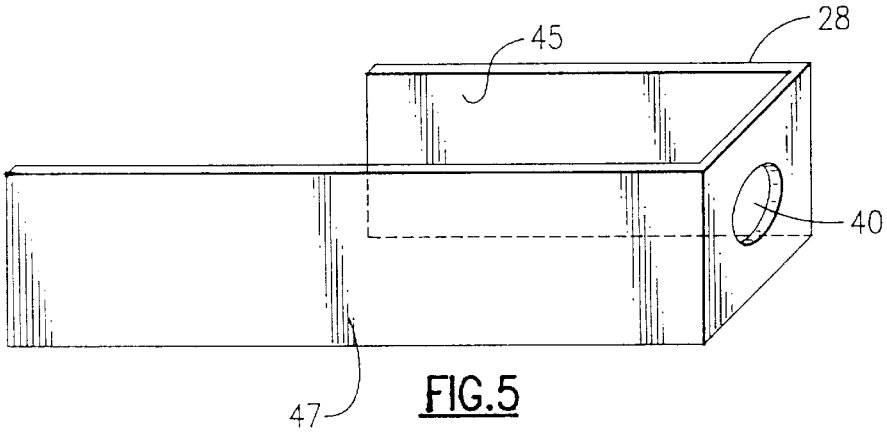
FIG. 5 is a perspective side view of a J-shape light support bracket according to the present invention.
Figure 6:
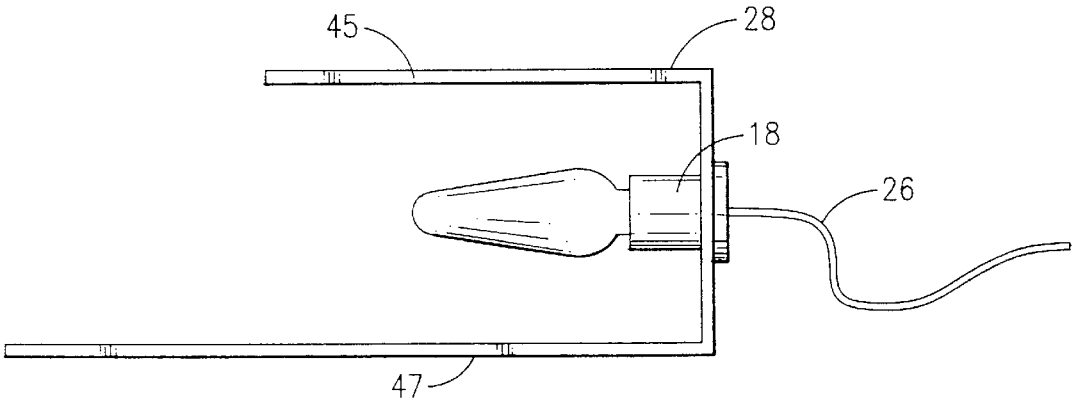
FIG. 6 is a side view of the J-shaped support light bracket of FIG. 5 containing a light source provided therein.

FIGS. 5 and FIG. 6 show the light holding bracket 28 containing a hole 40 for receiving the light source 18. The bracket 28 is preferably in a J-shape and made of metal. Alternatively, the bracket 28 may be U-shaped or box-shaped or any other suitable shape that allows light to be directed upwardly and downwardly. The J-shape form provides a short leg 45 and a long leg 47. FIG. 6 shows the bracket 28 containing the light 18. The light 18 is placed within the bracket 28 through the hold 40 with the electric cord 26 extending therefrom. The open space between the short and long legs 45 and 47, respectively, allows the light 18 to direct light above and blow either of the shelves 14 and 37 thereby creating bi-directional light 19 within the shelving unit 10 or in association with the display shelf 37.

Figure 7:
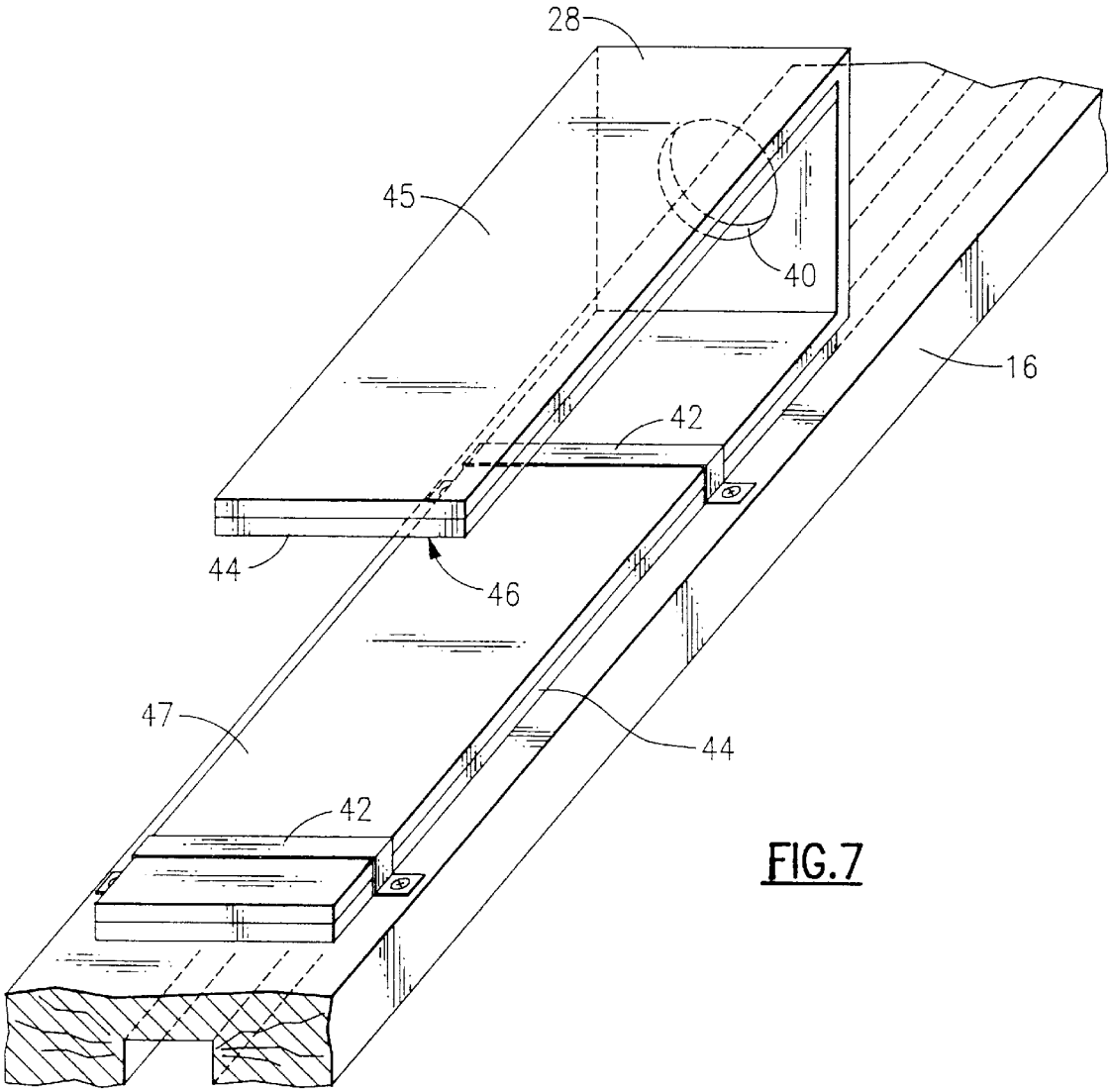
FIG. 7 is a perspective view of the light support bracket of FIG. 5 mounted to the light support member of FIG. 3.

FIG. 7 shows the bracket 28 mounted to the light support member 16 by two straps 42—42 across long leg 47. In one preferred embodiment, the straps 42—42 may be loosened to allow precise positioning of the bracket 28 along the longitudinal center line of the light support member 16. This allows light to be precisely centered on the light support member 16 relative to the shortened shelf 14 to thereby evenly distribute the light. The bracket 28 may be insulated with insulation 44 placed between long leg 47 and the light support member 16. The insulation 44 reduces heat transfer between the light 18 from reaching the wooden light support member 16 in the preferred embodiment. The light 18 is preferably 15 watts or less to reduce the amount of heat produced by the light 18. To further prevent heat from the light 18 from heating the display shelf 37, or surface 30, shelving unit 10, further insulation 44 may be placed on the short leg 45 of the bracket 28. Furthermore, the short leg 45 of the bracket 28 may contain a reflective layer 46 for providing greater bi-directional illumination from the light 18. In the preferred embodiment, the reflective layer 46 is tin foil. However, it should be appreciated that the entire bracket 28 may be fashioned from a reflective material thereby eliminating the need for a reflective layer. It should also be appreciated that the upper insulation 44 on the short leg 45 of the bracket 28 could also be made of reflective material, thereby eliminating the need for a reflective layer. An alternative embodiment for the bracket 28 is to fashion the bracket out of suitable non-conductive material thereby eliminating the need for insulation. In addition, the non-conductive material may be reflective or coated with reflective material.

While this invention has been described in detail with reference to certain preferred embodiments, it should be appreciated that the present invention is not limited to those precise embodiments. Rather, in view of the present disclosure which describes the current best mode for practicing the invention, many modifications and variations would present themselves to those of skill in the art without departing from the scope and spirit of this invention. The scope of the invention is, therefore, indicated by the following claims rather than by the foregoing description. All changes, modifications, and variations coming within the meaning and range of equivalency of the claims are to be considered within their scope.

What is claimed is:

1. An illuminated display unit, comprising:

at least one shelf having a top and a bottom surface and a front and a back edge;

at least one support member for attaching said shelf to a support surface;

a removable light support member releasably engaged with said back edge of said shelf, said removable light support member being releasably engaged with said back edge by hook and loop fastener means, and spaced away from said support surface to provide an air-gap therebetween, said removable light support member being releasable from said shelf through said air-gap; and a light attached to said removable light support member.

2. An illuminated display unit, comprising:

at least one shelf having a top and a bottom surface and a front and a back edge;

at least one support member for attaching said shelf to a support surface;

a removable light support member releasably engaged with said back edge of said shelf, said removable light support member having a front face containing a groove for snugly engaging said back edge of said shelf, said removable light support member being spaced away from said support surface to provide an air-gap therebetween, said removable light support member being releasable from said shelf through said airgap; and a light attached to said removable light support member.

3. The illuminated display unit according to claim 2 wherein said at least one shelf is fixed to said support surface.

4. The illuminated display unit according to claim 2 wherein said at least one shelf is removable from said support surface.

5. An illuminated display unit, comprising:

at least one shelf having a top and a bottom surface and a front and a back edge;

at least one support member for attaching said shelf to a support surface;

a removable light support member releasably engaged with said back edge of said shelf, said removable light support member being spaced away from said support surface to provide an air-gap therebetween, said removable light support member being releasable from said shelf through said airgap;

a light attached to said removable light support member; and a light holding bracket for mounting said light, said light holding bracket being secured to said removable light support member.

6. The illuminated display unit according to claim 5 wherein said light holding bracket is in secured to said removable light support member by at least one strap.

7. The illuminated display unit according to claim 6 wherein said at least one strap may be loosened to allow precise positioning of said light holding bracket along a longitudinal center line of said removable light support member.

8. The illuminated display shelf according to claim 5 wherein said light holding bracket has a long side having an inner and outer surface and a short side having an inside and outside surface, said outer surface having an insulation attached thereon to reduce heat transfer from said light to said light support member.

9. The illuminated display unit according to claim 8 wherein said inside surface has insulation affixed thereon.

10. The illuminated display unit according to claim 8 wherein said inner surface has a reflective material affixed thereon.

11. The illuminated display unit according to claim 5 wherein said bracket is made of reflective non-conductive material.

12. A display unit comprising:

a frame having a back and at least two supporting sides;

at least one shelf having a front and a back edge, said back edge of said shelf being spaced away from said back to provide a gap therebetween;

a removable light support member releasably engaged with said back edge of said shelf, said removable light support member being releasable from said shelf through said gap; and a light attached to said light support member.

13. The display unit according to claim 12 further including a light holding bracket for mounting said light, said light holding bracket being secured to said removable light support member.

14. The display unit according to claim 13 wherein said light holding bracket is in secured to said removable light support member by at least one strap.

15. The display unit according to claim 14 wherein said at least one strap may be loosened to allow precise positioning of said light holding bracket along a longitudinal center line of said removable light support member.

16. The display unit according to claim 13 wherein said light holding bracket has a long side having an inner and outer surface, and a short side having an inside and outside surface, said outer surface having an insulation attached thereon to reduce heat transfer from said light to said light support member.

17. The display unit according to claim 12 wherein said light support member includes a longitudinal bore for containing an electric supply cord extending from said light, said longitudinal bore thereby hiding said electric supply cord from view.

18. The display unit according to claim 12 wherein said removable light support member is releasably engaged with said back edge by hook and loop fastener means.

19. A method for illuminating a display unit, said method including the steps of:

providing at least one shelf having a top and a bottom surface and a front and a back edge;

attaching said shelf to a support surface by at least on support member; engaging a removable light support member with said edge of said shelf so that that said light support member is quickly releasable from said back edge, said light support member being spaced away from said support surface to provide an air-gap therebetween; and positioning a light on said light support member so that when said light support member is engaged with said back edge of said shelf, light is directed into the air-gap and above and below said shelf.

* * * * *